US006948337B2

(12) United States Patent
Moeller et al.

(10) Patent No.: US 6,948,337 B2
(45) **Date of Patent: *Sep. 27, 2005**

(54) LOW TEMPERATURE AIR FRACTIONATION SYSTEM

(75) Inventors: Stefan Moeller, Munich (DE); Wolfgang Bader, Ebenhausen (DE)

(73) Assignee: Linde AG, Wiesbaden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/344,667

(22) PCT Filed: Aug. 13, 2001

(86) PCT No.: PCT/EP01/09348

§ 371 (c)(1),
(2), (4) Date: Jul. 21, 2003

(87) PCT Pub. No.: WO02/16847

PCT Pub. Date: Feb. 28, 2002

(65) Prior Publication Data

US 2004/0000166 A1 Jan. 1, 2004

(30) Foreign Application Priority Data

Aug. 18, 2000 (DE) ..... 100 40 391

(51) Int. Cl.[7] ..... F25J 3/00; F25J 5/00

(52) U.S. Cl. ..... 62/643; 62/905; 62/911

(58) Field of Search ..... 62/643, 905, 911, 62/924

(56) References Cited

U.S. PATENT DOCUMENTS

| | | | | | |
|---|---|---|---|---|---|
| 5,412,954 | A | * | 5/1995 | Grenier | 62/646 |
| 5,461,871 | A | * | 10/1995 | Bracque et al. | 62/643 |
| 5,522,224 | A | * | 6/1996 | Canney | 62/656 |
| 5,893,276 | A | * | 4/1999 | Higginbotham | 62/651 |
| 6,148,637 | A | * | 11/2000 | Guillard et al. | 62/643 |
| 6,167,723 | B1 | * | 1/2001 | Guillard | 62/646 |
| 6,205,815 | B1 | * | 3/2001 | Bruder et al. | 62/643 |
| 6,212,907 | B1 | * | 4/2001 | Billingham et al. | 62/646 |

* cited by examiner

*Primary Examiner*—William C. Doerrler
(74) *Attorney, Agent, or Firm*—Millen, White, Zelano & Branigan, P.C.

(57) ABSTRACT

The invention relates to a low temperature air fractionation system comprising several modules consisting of at least one heat exchange unit, a pressure column and a low pressure column, in addition to the accessories belonging to the respective modules and at least two cold-boxes, wherein the module and/or the accessories are arranged. The invention is characterized in that at least one of the cold-boxes is embodied in the form of a main box and at least one of the cold-boxes is embodied in the form of a secondary box. The secondary box contains at least one module and the accessories of the module disposed in the secondary box are mainly located in the main box.

12 Claims, 3 Drawing Sheets

LOW TEMPERATURE AIR FRACTIONATION SYSTEM

The invention relates to a low-temperature air separation system with several modules, which comprise at least one heat exchanger unit, a pressure column, and a low-pressure column, and with the accessories that belong to the respective modules and with at least two coldboxes, in which the modules and/or the accessories are located.

To recover argon by low-temperature rectification, a fraction containing essentially oxygen, nitrogen and argon is removed from the low-pressure column of a two-column apparatus at an intermediate point and delivered to a raw argon column. Then, oxygen is removed from the argon in the raw argon column, and the argon is removed at the head of the raw argon column as an oxygen-free product. The raw argon column is ordinarily located such that its bottom is located roughly at the height of the argon taphole of the low-pressure column.

Under certain circumstances, the raw argon column, however, has a very large structural height so that the set-up and alignment of the raw argon column and the thermal insulating jacket that surrounds the column, a so-called coldbox, become very complex. In EP-A-0 628 777, it is therefore proposed that the raw argon column be divided into two component columns, the first component column extending from the height of the argon taphole to at most the head of the low-pressure column and the size of the second component column being chosen according to process conditions.

EP-A-0 870 524 uses this approach and suggests a low-temperature air separation system in which the raw argon column is likewise divided and the columns are arranged such that the coldbox surrounding the columns is filled as completely as possible.

Larger low-temperature air separation systems of this type are, however, not transportable and must therefore be set up where they are to be used. Even when the system is divided into a rectification module, in which essentially oxygen-nitrogen separation takes place, and into an argon module that comprises a raw argon column with its accessories, the two coldboxes are often so large that they are no longer transportable. Production at the manufacturer's plant is thus not possible.

The object of this invention is to develop a low-temperature air separation system that is as easy as possible to produce.

This object is achieved according to the invention by a system of the initially mentioned type in which at least one of the coldboxes is made as the main box and at least one of the coldboxes is made as a secondary box, the secondary box containing at least one of the modules and the accessories of the module that is located in the secondary box being located primarily in the main box.

Within the framework of this description, the components of the low-temperature air separation system are conceptually divided into modules, accessories and piping. The modules comprise all components that enable one of the functions specific to low-temperature air separation. The modules that are to be thermally insulated include especially machines such as, e.g., expansion machines and cryogenic pumps, heat exchange devices, such as, e.g., the main heat exchanger, main condenser, head condensers and secondary condensers, as well as equipment for separation of air, such as countercurrent heat exchangers and rectification columns.

Among the accessories are especially the instrumentation, fittings, measuring devices, e.g., for flow rate measurements and analysis, measurement lines and inspection means and similar structural devices. The pipelines are not included among the accessories within the framework of this description, if not indicated explicitly otherwise, but are considered separately.

A coldbox is defined as a container, a jacket or a covering that is suitable for accommodating one or more components, especially modules, of a low-temperature air separation system and insulating them thermally against the environment. The coldbox is either itself thermally insulated or can be filled with a suitable thermal insulation material.

According to the invention, the modules to be housed in the coldboxes, i.e. the modules that are to be thermally insulated, are divided among at least two coldboxes. For example, the two component columns of a divided raw argon column each can have its own coldbox. The pressure column and the low-pressure column can be accommodated in another coldbox or likewise divided among two coldboxes. In this way, the coldbox sizes can be reduced, facilitating transport.

The division of the modules among the coldboxes takes place according to the invention such that at least one coldbox is kept as simple as possible. This is achieved in the sense of the invention by one coldbox being made as a secondary box in which essentially only modules without their accessories are located. A main box is assigned to the secondary box and contains most of the accessories of the modules located in the secondary box. The secondary box can thus be made very simple and is easy and economical to produce.

The main box is preferably made such that it comprises not only the accessories of the assigned secondary box, but itself contains one of the modules. Under certain circumstances it is also a good idea to accommodate only the accessories of the modules of the secondary boxes in the main box.

The invention is especially valuable in a low-temperature air separation system that has a raw argon rectification unit that comprises a first and a second component column, a raw argon line that leads from the upper area of the first component column into the lower area of the second component column, means for returning the reflux liquid from the bottom of the second component column to the upper area of the first component column and an argon head condenser with a condensation side that is connected to the upper area of the second component column.

The raw argon column in one such system is divided into two parts in order to reduce the structural height. The two component columns are housed in different coldboxes. The first component column itself does not have a head condenser, but is supplied from the bottom of the second component column with the necessary reflux liquid. The first component column therefore has essentially only connections for delivering and discharging liquid and gas to the low-pressure column and to the second component column.

Preferably the accessories to the first component column, such as, e.g., the inspection devices, measurement and analysis means, are not located in the coldbox that contains the first component column, but mainly in the coldbox for the second component column. The coldbox with the first component column can thus be made very simple and in the sense of this invention constitutes the secondary box. The second coldbox contains as the main box the second component column, the argon head condenser and the accessories to the two component columns. The raw argon rectification unit can thus be divided into two modules, and neither exceed allowable transport dimensions, and the first module can be prefabricated especially easily.

In one especially preferred version, a pure argon column with its accessories is integrated into the main box with the second component column. Not only all accessories, but also all the piping of the raw argon rectification unit are especially preferably located in the main box.

In addition to the described division of the raw argon rectification unit into a secondary box with the first component column and a main box with the second component column, a division of the raw argon rectification unit into a main box with two assigned secondary boxes has proven advantageous, especially in very large air separation systems.

In this variant, the raw argon rectification unit is likewise divided into two component columns. Preferably the two component columns are each located in a secondary box. In this case, a first secondary box encompasses the first component column, and a second secondary box encompasses the second component column with the argon head condenser. For the accessories of the two component modules, there is a main box that also contains especially preferably the piping of the two component columns.

If the argon rectification unit is provided with a pure argon column, it is advantageous to place the pure argon column with the accessories in the main box.

Preferably more than 60%, especially preferably more than 70% and quite especially preferably more than 80% of accessories of the modules of the secondary box are housed in the pertinent main box. In other words, in the secondary box are at most 40% of the fittings, at most 40% of the instruments, at most 40% of the measurement lines and means and at most 40% of the inspection means. Preferably the portion of the above-mentioned accessories located in the secondary box is at most 30%, especially preferably at most 20%.

The piping of the module housed in the secondary box is quite especially preferably located mostly in the assigned main box, advantageously more than 60%, especially advantageously more than 70% and quite especially advantageously more than 80% of the piping being assigned to the main box.

For production reasons, it is a good idea to make the main box and the secondary box cuboidal, i.e., with a rectangular outline, since in this way the connections to the boxes and the lines through the walls of the boxes are easier to produce. It also yields advantages, however, when the shape of the main box and/or of the secondary box is matched to the shape of the modules and/or accessories that are to be housed in the box. Thus, it is advantageous to surround a rectification column that is to be housed in the secondary box, for example the first component column of a divided raw argon rectification unit, with a cylindrical box.

The concept of division into a main box with an assigned secondary box according to the invention that has proven itself in a divided raw argon column can, of course, also be applied to the nitrogen-oxygen rectification unit. It is likewise advantageous to place the pressure column and the low-pressure column in one secondary box each and to provide a main box that contains essentially only the accessories of the pressure column and low-pressure column. Furthermore, a version in which in the main box is the low-pressure column, optionally with a supercooling countercurrent heat exchanger, and in the secondary box is the pressure column, preferably with the main condenser, is advantageous. The variant in which the coldbox of the pressure column is made as the main box and that of the low-pressure column is made as the secondary box also yields advantages. In all of the above-mentioned variants, there is preferably a large part of the piping in the main box.

The invention and further details of the invention are explained below using embodiments shown in the schematics. Here:

DETAILED DESCRIPTION OF DRAWINGS

Figure 1:
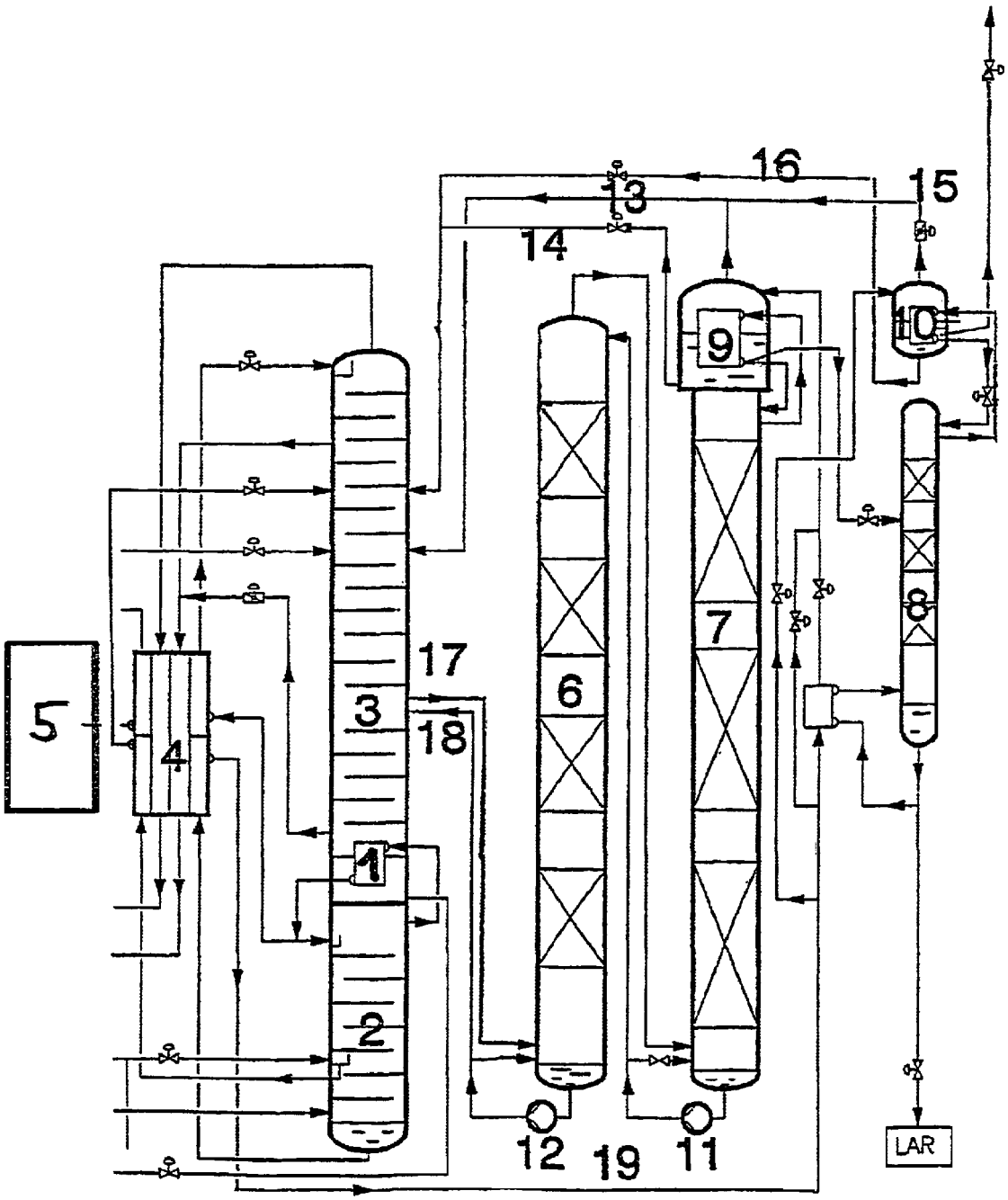
FIG. 1 shows the process diagram of an air separation system according to the invention.

The air separation system shown in FIG. 1 has a double column rectifier with a main condenser 1, a pressure column 2, and a low-pressure column 3 for recovering nitrogen at the head of the low-pressure column 3 and oxygen from the bottom of the low-pressure column 3. The double column is housed jointly with the supercooling countercurrent heat exchanger 4 and other cold components that are not shown, such as, e.g., cryogenic pumps, housed in several coldboxes that are arranged as explained in more detail using FIGS. 2 to 6.

The argon rectification unit consists of two component columns 6, 7 that form a raw argon column, of a pure argon column 8 and the corresponding head condensers 9, 10. The first component column 6 is connected to the low-pressure column 3 in the conventional manner by a line 17, via which a fraction containing essentially oxygen and argon can be fed into the first component column 6. The return line 18 is used to return residual liquid that collects in the bottom of the first component column 6 to the low-pressure column 3. In this return line 18, there is a pump 12 for delivering the residual liquid.

The first component column 6 does not have a head condenser. The reflux liquid for this column 6 is formed by the bottom liquid of the second component column 7 that is pumped by means of a pump 11 to the head of the component column 6. In the head condenser 9, the reflux liquid for the second part 7 of the raw argon column is produced by condensation of the head fraction in indirect heat exchange with the bottom liquid from the pressure column 2 that is supplied via the line 19. The resulting vapor is returned to the low-pressure column 3 via the line 13. Excess bottom liquid is supplied to the low-pressure column 3 from the head condenser 9 via the line 14. Analogously, the head condenser 10 of the pure argon column 8 is supplied with bottom liquid from the pressure column 2. The vapor that forms and the excess liquid are routed likewise into the low-pressure column 3 via the lines 15 and 16 that discharge into the lines 13 and 14.

All parts of the system that are to be thermally insulated are housed in coldboxes that are filled with perlite. The division of the individual models and accessories is explained in more detail below using FIGS. 2 to 15. In drawings 2 to 15, the main box is outlined with a thick line, the secondary box is shown by the broken line, and the assignment of the main and secondary box is illustrated by a double arrow. The rectangle symbolizes respectively the coldbox 21 for the main heat exchanger 5. Squares and rectangles drawn with an ordinary line thickness identify conventional coldboxes without the main or secondary box character according to the invention.

Figure 2:
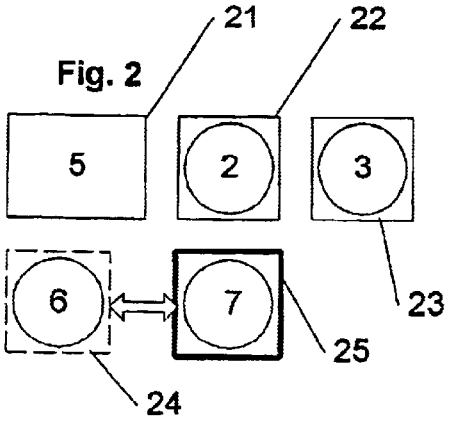
FIGS. 2 and 3 show air separation systems according to the invention in which a divided raw argon column is housed in a main box and a secondary box.

In the arrangement according to FIG. 2, the main heat exchanger 5, the pressure column 2, the low-pressure column 3, and the two component columns 6, 7 for raw argon rectification are each housed in its own coldbox 21, 22, 23, 24, 25. The coldbox 25 that contains the second component column 7 is made as the main box to which the coldbox 24 that contains the first component column 6 is assigned as the secondary box. The main box 25 comprises in addition to the component column 7 also the argon head condenser 9, the pure argon column 8 and its head condenser 10. Furthermore, more than three fourths of the accessories of the first component column 6, i.e. the measurement and control means, the fittings and the inspection means as well as more than three-fourths of the piping of the first component column are located in the main box 25.

Figure 3:
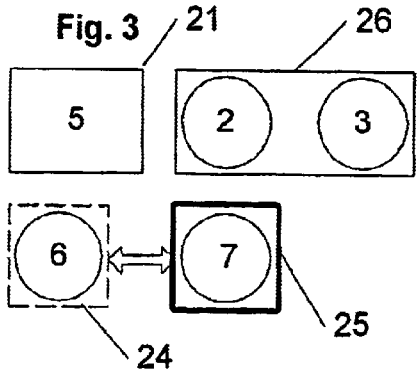

FIG. 3 shows an alternative embodiment in which there is a common coldbox 26 for the pressure column 2 and the low-pressure column 3. The coldboxes 24, 25 of the two component columns 6 and 7 likewise have the main box-secondary box ratio explained using FIG. 2.

The individual coldboxes are interconnected among one another via connecting boxes in which, for example, the connecting lines run. It is also advantageous for all the arrangements shown in the Figures to place directly next to one another two or more coldboxes that must be connected to one another, to connect them to one another and to remove the common wall of the coldboxes so that a single coldbox is formed.

Figure 4:
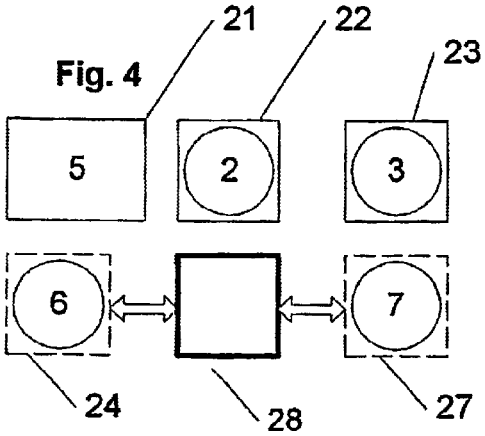
FIGS. 4 and 5 show an alternative division of a divided raw argon column among the main and secondary boxes.
Figure 5:
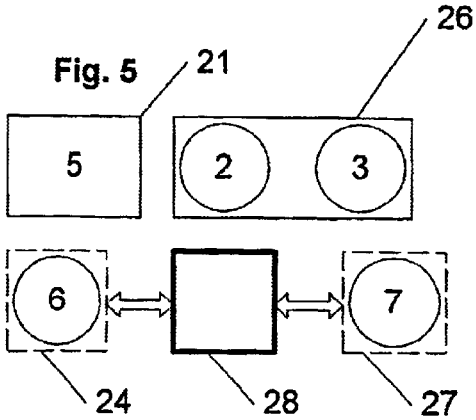

The two embodiments according to FIG. 4 and FIG. 5 differ from those of FIGS. 2 and 3 in that the second component column 7 is likewise located in a secondary box 27. The main box 28 comprises most of the accessories of the two component columns 6, 7, the pure argon column 8 and the condensers 9, 10 and the pure argon column 8. Furthermore, the cold piping of the two raw argon component modules 6, 7, i.e. the piping to be insulated, is contained in the main box 28. The pressure column 2 and the low-pressure column 3 are each housed in its own coldbox 22, 23.

FIG. 5 corresponds essentially to FIG. 4 however the pressure column 2 and the low-pressure column 2, analogously to the execution according to FIG. 3, are located in a common coldbox 26. The argon rectification unit with the two component columns 6, 7 is divided among two secondary boxes 24, 27 for the component columns 6, 7 and a main box 28 that contains the corresponding accessories and the piping.

FIGS. 6 to 15 show other embodiments of the concept according to the invention in the division of the coldboxes into main and secondary boxes.

Figure 6:
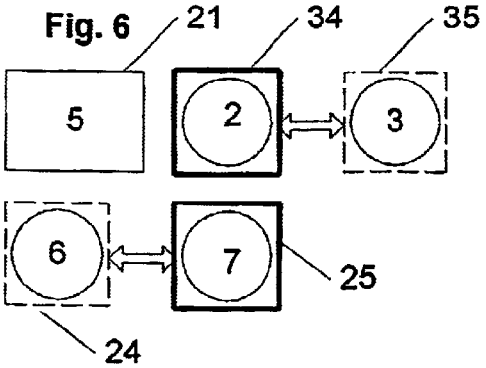
FIGS. 6 to 15 show analogous versions with division of the pressure and low-pressure column among the main and secondary boxes.

FIG. 6 shows a low-temperature air separation system in which the coldbox for the double column consisting of the pressure column 2 and the low-pressure column 3 is divided according to the invention. In this case, the low-pressure column 3 is housed in a secondary box 35. The pressure column 2 with the main condenser and the accessories of the low-pressure column 3 is located in the main box 34. The raw argon column is divided and, as already shown in FIG. 2, is likewise located in two coldboxes 24, 25 that are made as the main and secondary box. For large systems, this version itself allows the transport of individual modules with the pertinent coldboxes.

Figure 7:
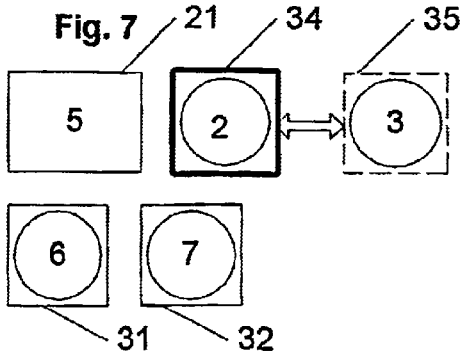

FIG. 7 shows one modification of the arrangement of FIG. 6, in which the raw argon column is divided and is housed in two coldboxes 31, 32, in which the two coldboxes 31, 32 for the first and the second component column 6, 7 are made in the conventional manner, i.e., in which all of the accessories assigned to the respective component columns 6, 7 are also located in the corresponding coldbox 31, 32.

Figure 8:
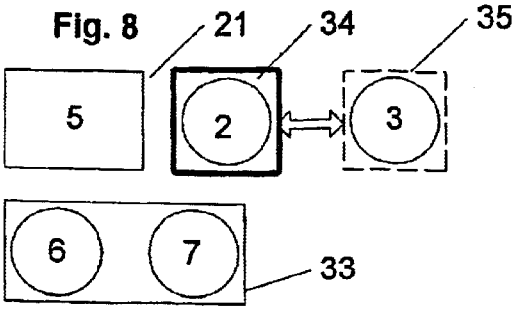

In another variant FIG. 8 of this embodiment that is preferred especially in a system with a smaller argon rectification unit, there is a common coldbox 33 for the two component columns 6, 7 for argon recovery. The two component columns 6, 7 are generally located next to one another. It has also proven advantageous, however, to provide the second component column 7 with the head condenser under the first component column 6. Since the bottom of the first component column 6 is located at the height of the argon tap from the low-pressure column 3, in the coldbox 33 underneath the first component column 6 there is space that is used preferably for the second component column 7. To supply the first component column 6 with reflux liquid, bottom liquid from the second component column 7 is pumped to the head of the first component column 6.

Figure 9:
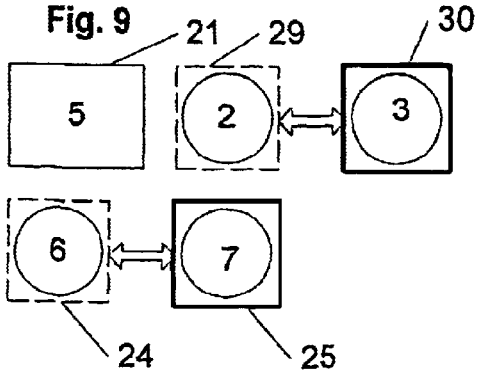
Figure 10:
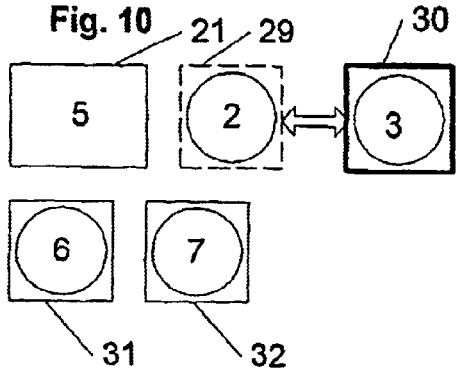
Figure 11:
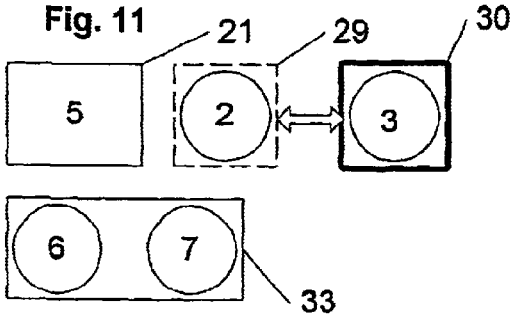
Figure 12:
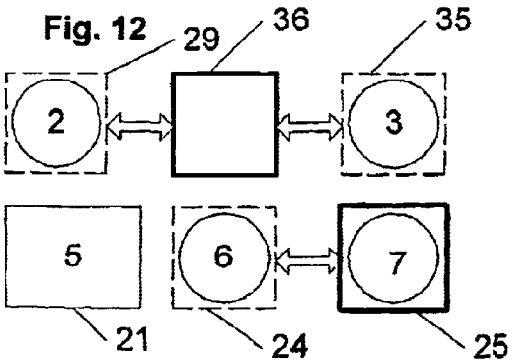

Instead of the embodiment of the pressure column box as the main box and the low-pressure column box as the secondary box, it can also be advantageous to embody vice versa the pressure column box 29 as the secondary box and the low-pressure column box 30 as the main box. Various variants of this embodiment are shown in FIGS. 9 to 11. FIGS. 9 to 11 correspond here to the arrangements according to FIGS. 6 to 8, only the main box-secondary box relation between the pressure column box and the low-pressure column box being interchanged. The main condenser can be located either with the low-pressure column 3 and the accessories of the pressure column 2 and those of the low-pressure column 3 in the main box 30 or placed preferably on or above the pressure column 2 and installed in the secondary box 29.

FIGS. 12 to 15 shows other advantageous variants. According to FIG. 12, there is a separate main box 36 for the accessories of the pressure column 2 and the low-pressure column 3. The pressure column 2 and the low-pressure column 3 are conversely each housed in a secondary box 29, 35. This has the advantage that the two secondary boxes 29, 35 can be produced more easily since they contain essentially only the respective rectification column 2, 3. In a preferred embodiment, the main condenser is also integrated here into the secondary box 29 with the pressure column. The two component columns 6, 7 of the raw argon column are likewise interconnected in two via the main box-secondary box principle according to the invention.

Figure 13:
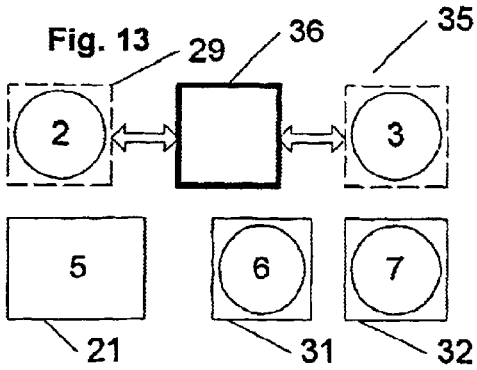
Figure 14:
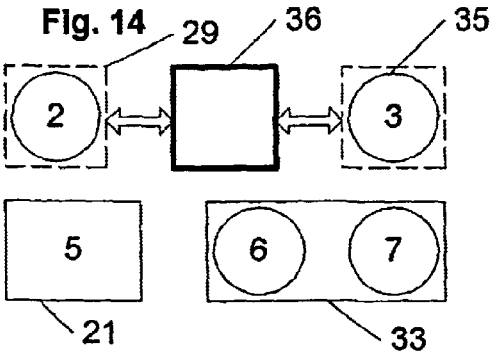
Figure 15:
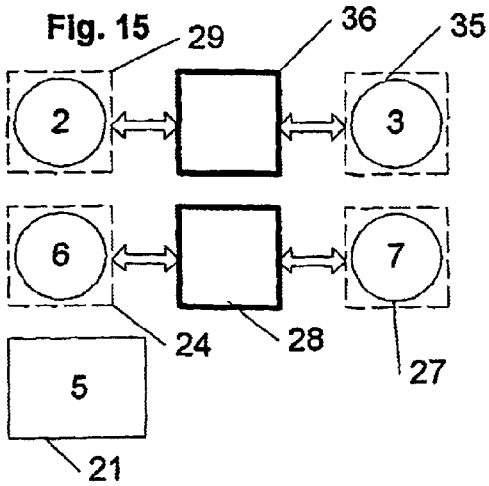

FIGS. 13 and 14 show slight modifications of the arrangement according to FIG. 6*a*, in which the two component columns 6, 7 are housed, on the one hand, in two conventional coldboxes 31, 32 that are not connected to one another according to the invention (FIG. 13), and, on the other hand, can be found in a common coldbox 33 (FIG. 14). Finally, FIG. 15 shows an arrangement in which both the pressure column 2 and the low-pressure column 3 as well as the two component columns 6, 7 are housed in separate secondary boxes 29, 35, 24, 27, and there are two main boxes 36, 28 that are assigned, on the one hand, to the secondary boxes 29, 35, and, on the other hand, to the secondary boxes 24, 27. An arrangement in which a single main box is connected to the four secondary boxes 29, 35, 24, 27 is not shown, but is also advantageous depending on the number and size of the accessories.

The various figures are intended to illustrate the type of coldboxes used for the different modules, i.e., whether a main box, a secondary box, or a conventional coldbox is used. Their arrangement to one another is not absolutely correctly reproduced in the figures. Preferably, the coldboxes are arranged such that the coldboxes between which many pipe connections and other connecting lines run are as close together as possible. Thus, for example, it is advantageous to locate the coldbox 21 with the main heat exchanger next to the low-pressure column box and to have the pressure column box and the raw argon column box(es) border the low-pressure column box. The connection of the coldboxes among one another takes place via insulated connecting boxes or by joining the affected coldboxes to one another and removing the intermediate wall.

What is claimed is:

1. A multiple module low-temperature air separation system comprising at least one heat exchanger unit, high pressure rectification column including high pressure column accessories, and a low-pressure rectification column including low pressure column accessories, and at least two coldboxes, wherein at least one of the coldboxes is a first main coldbox containing one of the high and low pressure rectification columns and at least one of the coldboxes is a first secondary coldbox containing the other high or low pressure rectification column, and the first main coldbox comprising (A) the accessories associated with the rectification column within said first main coldbox and (B) most of the accessories associated with but apart from the other rectification column in the first secondary coldbox, said accessories including measurement, control and inspection devices.

2. A low-temperature air separation system according to claim 1, further comprising a raw argon rectification unit comprising first and second component rectification columns associated accessories (6, 7), a raw argon line that leads from the upper area of the first component column (6) into the lower area of the second component column (7), means (11) for returning the reflux liquid from the bottom of the second component column (7) to the upper area of the first component column (6) and an argon head condenser (9) with a condensation side that is connected to the upper area of the second component column (7), a second secondary coldbox containing the first component column (6) and a second main coldbox containing the second component column (7) and the argon head condenser (9) and most of the accessories of the first component column (6).

3. Low-temperature air separation system according to claim 2, wherein the second secondary coldbox contains a pure argon column (8).

4. A low-temperature air separation system according to claim 1, wherein more than 60%, of accessories are located in the first main box.

5. A low-temperature air separation system according to claim 1, wherein in the low-pressure column (3) is in the first main cold box (30) and the pressure column (2) is in the first secondary cold box (29).

6. A low-temperature air separation system according to claim 1, wherein in the pressure column (2) is in the first main cold box (34) and the low-pressure column (3) is in the first secondary cold box (35).

7. A low-temperature air separation system according to claim 1, wherein a secondary cold box contains a raw argon rectification unit.

8. A low-temperature air separation system according to claim 1, wherein the piping associated with the column in the first secondary cold box is located primarily in the first main coldbox.

9. A low-temperature air separation system according to claim 1, wherein more than 70%, of accessories are located in the first main coldbox.

10. A low-temperature air separation system according to claim 1, wherein more than 80%, of accessories are located in the first main coldbox.

11. A low temperature or separation system according to claim 1, wherein all coldboxes are insulated with perlite.

12. A low temperature or separation system according to claim 2, wherein all coldboxes are insulated with perlite.

* * * * *